US005371954A

United States Patent [19]

Pinter et al.

[11] Patent Number: 5,371,954

[45] Date of Patent: Dec. 13, 1994

[54] METHOD AND APPARATUS FOR THE GUIDING OF FIBRE WEBS

[75] Inventors: Reinhard Pinter; Wolfgang Promitzer, both of Graz; Adolf Gopg, Köflach, all of Austria

[73] Assignee: Sulzer-Escher Wyss GmbH, Ravensburg, Germany

[21] Appl. No.: 992,639

[22] Filed: Dec. 18, 1992

[30] Foreign Application Priority Data

Dec. 19, 1991 [AT] Austria ..... A 2519/91

[51] Int. Cl.[5] ..... D21F 3/10; F26B 13/30

[52] U.S. Cl. ..... 34/115; 34/117; 34/120

[58] Field of Search ..... 34/115, 116, 117, 120, 34/111, 113, 114, 122

[56] References Cited

FOREIGN PATENT DOCUMENTS 9011461 10/1991 Germany .

*Primary Examiner*—Denise L. Gromada
*Attorney, Agent, or Firm*—Townsend & Townsend Khourie & Crew

[57] ABSTRACT

A process for the guiding of fibre web or the like, in particular for paper production, especially in paper driers, wherein the suction applied can be varied both in real time operation and along the axes of the one or more suction rolls that is/are present and which may be used in conjunction with at least one travelling screen or the like. The object is to make the start-up process for the treatment of fibre webs on suction rolls more convenient without too much equipmental and operational overhead, and to prevent shrinkage of the web by providing good location at the web in the edge regions. This is achieved by restricting the suction which acts on the inside of the roll jacket to a region of the roll jacket which comes into contact with a lead-in strip for the fibre web during start-up operation. This process is continued until a sufficient length of fibre web has passed over the suction roll for the web to have reached its full or final width on this suction roll. As the web width increases the suction spreads out to encompass the full width of the fibre web. The control of the vacuum within the compartments of the suction roll is preferably effected by means of valve discs provided on slide rods.

29 Claims, 4 Drawing Sheets

METHOD AND APPARATUS FOR THE GUIDING OF FIBRE WEBS

TITLE OF INVENTION

1. Field of Invention

The invention relates to a method for the guiding of fibre webs or similar, in particular for paper production, especially in paper driers, optionally together with at least one travelling sieve or screen or the like, over at least one suction roll which is single jacketed in at least its middle region, wherein a differential suction action is exerted on the fibre web and, in continuous operation, after the run-in of the fibre web to its full width or end width the suction is extended over the full width of the fibre web.

The invention also relates to apparatus for guiding such fibre webs.

2. Discussion of Prior Art

Methods and apparatus of this kind are already known, and are presented and described in U.S. Pat. No. 4,876,803. The known suction rolls have zones in their edge region or regions which can be operated at a higher vacuum than in the remaining regions of the roll. Generally, this serves to allow a higher vacuum to be applied during start-up operation for a so-called lead-in strip, i.e. for a narrow strip of paper at the end. The remaining region of the suction roll is often blocked off in some way, for instance by flaps. It is therefore not possible to create different vacuum conditions over the width of the web, i.e. in the direction of the roll axis, during normal operation. Because the vacuum is, practically speaking, not adjustable, it is also not possible to achieve adaptation in the longitudinal machine direction of the machines, i.e. different vacua cannot be independently set for successive suction rolls. Therefore, it is not possible to respond to the differing requirements for different types of paper.

Furthermore, a seal is necessary in the region of the roll periphery, which does not come into contact with the paper, so that as little leakage air as possible is sucked in. This seal can be effected either inside of the roll by a fixed element or on the outside in the form of a cover. The apparatus necessary to form these seals is relatively complex and costly and there are serious problems involved in the formation of a seal between the static and rotating components. In particular, when the seals are worn, the admission of leakage air increases significantly, thereby considerably reducing the practical efficacy of the suction roll in its web guiding and web fixing functions.

PRINCIPAL OBJECT OF THE INVENTION

The object of the invention is to avoid the above mentioned disadvantages and in particular to prevent shrinkage of the web by providing for good fixation of the edge regions.

BRIEF DESCRIPTION OF THE INVENTION

The object of the invention is solved by an arrangement of the initially named kind, but characterised in that suction is applied from the interior of the suction roll directly to the inner side of the roll jacket, at least in an edge region of the roll jacket, in particular in the start-up region when applying a lead-in strip which is narrow in comparison to the full or end width of the fibre web.

Thus, according to the invention, processes and devices are provided in order to achieve a controlled adjustment of the vacuum profile along the roll axis. Even during operation, these processes and devices ensure fixation of the paper web, in particular in the edge regions, thereby hindering shrinkage of the paper web which leads to considerable improvements in quality during paper production when compared with the prior art.

It is advantageous to continuously regulate the position and strength of the suction effect. According to a further advantageous form of the invention, the suction is regulated by means of a computer control acting on a suction air distribution within the suction roll, which has a single jacket at least in its central region, and optionally on a vacuum generator, in particular on the drive of a vacuum pump, wherein desired values or a desired value curve for the position inside the suction roll and/or the magnitude and/or the duration of the suction power to be applied are preset for the computer, which can take place in dependence on signal sensors which sense the width of the fibre web.

During normal operation, the control of the vacuum or vacuum profile may also be achieved with sensors mounted at the edge. In this case, the desired prevention of shrinkage is achieved in that if any shrinkage occurs the sensors at the edge of the web respond and thus the vacuum is correspondingly increased at least in this area. This can be done by using the sensor signals to control the strength of the vacuum by appropriate control of the vacuum generator.

According to the invention, an apparatus for the realisation of the method of the invention, comprises at least one suction roll having a jacket with openings, in particular perforations, and with compartments in the roll interior, comprising at least one compartment in a single jacketed central region and compartments at the ends of the roll, wherein a vacuum generator is connected to the compartments and at least one regulating device for the stepless control of the suction air quantity, i.e. of the vacuum, in at least one of the compartments is provided which can be controlled externally and during operation, characterised in that both end compartments are separately connected to the vacuum generator and directly communicate with the latter at the inner side of the suction roll jacket which is single jacketed in this region, and in that, for the adjustment of the range of action of the suction air during operation, at least one end compartment is separable, in particular fully separable from the remaining region of the suction roll through the at least one regulating device.

Moreover, for the purpose of influencing the suction over the length of the suction roll, at least two regulating devices can be provided, there being at least one in the region of each of the two ends of the suction roll.

Furthermore, it is advantageous if the perforation of the roll jacket is varied along the direction of the roll axis. According to the invention, the perforations can be in the form of holes. A better location of the web in both start-up operation as well as in normal operation is achieved by having a larger open area, i.e. hole area, in the end region of between about 1 to 2%, preferably 1.4%, of the total area. If, simultaneously, a smaller open area is provided in the central region in the range of ca.0.4 to 1%, in particular 0.7%, then the amount of air which needs to be pumped out can be kept low and the leakage air contribution is small.

It can also be advantageous if the perforation openings in the roll jacket have the form of cylindrical holes. Advantages both in manufacture and operation can arise if the holes are countersunk on the outer side of the roll jacket. Because the device is designed to adjust the vacuum profile during operation, special effects can be achieved by the invention. Practical solutions are found by making the devices for the adjustment of the vacuum profile in the form of discs fixed onto slide rods and by making the combined unit of discs and slide rods separate from the rotating part of the suction roll so that the unit remains stationary when the rotating suction roll is in operation. A gap is provided between the discs and the rotating parts of the suction roll. It is advantageous when the aforementioned gap is adjustable. The vacuum distribution can be especially well controlled if a plurality of discs are provided; to this end at least two discs may be mounted on the same slide rod. A particular possibility of variation is achieved by making at least one slide rod tubular, thereby enabling it to be sleeved over at least one further slide rod.

Adjustment of the operating conditions can be particularly easily made if at least one baffle arrangement is installed in the inner volume to prevent or reduce any rotation or vortex-like formation of the flow, in those positions where such effects may arise. Practical embodiments according to the invention are, in this case, characterised in that the baffle arrangement is fixed to the inner roll surface or to the slide rod or rods; or is mounted on the disc or discs; or in that at least one baffle arrangement is provided to calm the flow between the individual zones of different pressure.

A useful embodiment of the device according to the invention is achieved if the suction roll is provided with at least one fixed suction space which is connected to at least one pumping out line, the suction space being connected to the roll interior via openings which are positioned in a cover or alternatively in an end face of the roll. In this way, the suction roll can be provided with chambers which can be separately evacuated and which can be formed by the end regions of the suction roll jacket and a further solid walled cylindrical roll jacket positioned concentrically inside the suction roll jacket and fixedly connected thereto.

It is useful when the embodiment described above with a fixed suction space, is realised in such a way that when the space is pumped out from both sides, adjustable restrictor elements are provided to influence the vacuum inside the roll's middle chamber, or in the case of one-sided pumping, if adjustable restrictor elements are provided to influence the vacuum not only in the middle chamber but also in the end chamber of the roll remote from the suction source. In this case the restrictor elements can be in the form of flaps, which if required can serve to fully block off the suction, for instance during start-up operation. According to the invention, at least one additional restrictor element, preferably a flap, can be provided to completely prevent the suction action on the end or edge chambers of the roll, in particular during start-up operation.

The entire plant can be configured according to the invention and correspondingly controlled with reference to the suction of the suction rolls. Accordingly, the invention is characterised in further embodiments in that at least two suction rolls are connected in series, in the direction of web travel, in particular when the web passes over at least one further intermediate roll, for instance a drying cylinder, and in that regulating devices which can be operated during operation, especially from the outside and independently for the individual suction rolls, are provided for the continuous control of the magnitude and the range of action of the suction air at the suction roll jacket and in the compartments of the roll interior in each of the suction rolls.

By appropriate measures, many zones of different vacuum can be provided in the suction roll.

An apparatus for drying a paper web is admittedly already known from U.S. Pat. No. 5,031,338 in which the paper web is led over a perforated jacket of a suction roll. In this patent, the suction roll is also provided with compartments in its roll interior, both in the area of the roll ends or end faces, as well as between the end faces. Additionally, a vacuum pump is connected to the suction roll compartments. In contrast to the present invention, the prior art device has at least two concentrically arranged cylinders which extend over the full length of the suction roll, each of which has a perforated jacket. Since, in the prior art, the outer jacket rotates during operation while the inner jacket or jackets remain stationary, it was necessary to provide ring shaped seals between the outermost jackets to form separate compartments, with the seals being subjected to considerable loads. With this prior art, the manufacturing effort is greater than for the essentially single jacketed suction roll of the current invention. Also, the operational safety of the prior art arrangement is lower as a result of wear in the seals which have to be present between those jackets which move relative to each other.

Furthermore, the adjustment range for the suction is drastically reduced due to the available volumes being positioned between the concentrically arranged jackets and the previously mentioned seals, as well as due to the adjustable flaps. Additionally, a notable energy loss occurs in the prior art during pumping, because the air pumped out must pass through at least two perforated jackets. This comment holds for the full length of the suction roll. Also, the restricted size of the air spaces between the two or more perforated cylinders of the prior art construction results in a much reduced buffer volume. In contrast, according to the invention, the suction always takes place directly adjacent to the inside surface of the roll jacket. Furthermore, according to the invention, regulating devices are provided which can be adjusted during operation, thereby allowing a continuous control of the magnitude and profile of the pressure directly adjacent to the suction roll jacket, which is single walled in at least its middle region, as well as in the compartments of the roll's interior. According to the invention, suction takes place from inside the roll and directly adjacent to the inside surface of the suction roll jacket during a start-up procedure in the region of the lead-in strip. Operation continues without interruption until a point is reached where the fibre web at the suction roll, which is single jacketed in at least its central region, reaches its full or final width. At this point the suction acting directly adjacent to the inside surface of the roll jacket will have been correspondingly extended to cover the full width of the fibre web. In the above case, it is advantageous to continuously regulate the profile and strength of the suction in accordance with the invention.

BRIEF DESCRIPTION OF THE DRAWINGS

The invention will now be described in further detail with reference to examples and to the figures in which.

DESCRIPTION OF PREFERRED EMBODIMENTS

Figure 1:
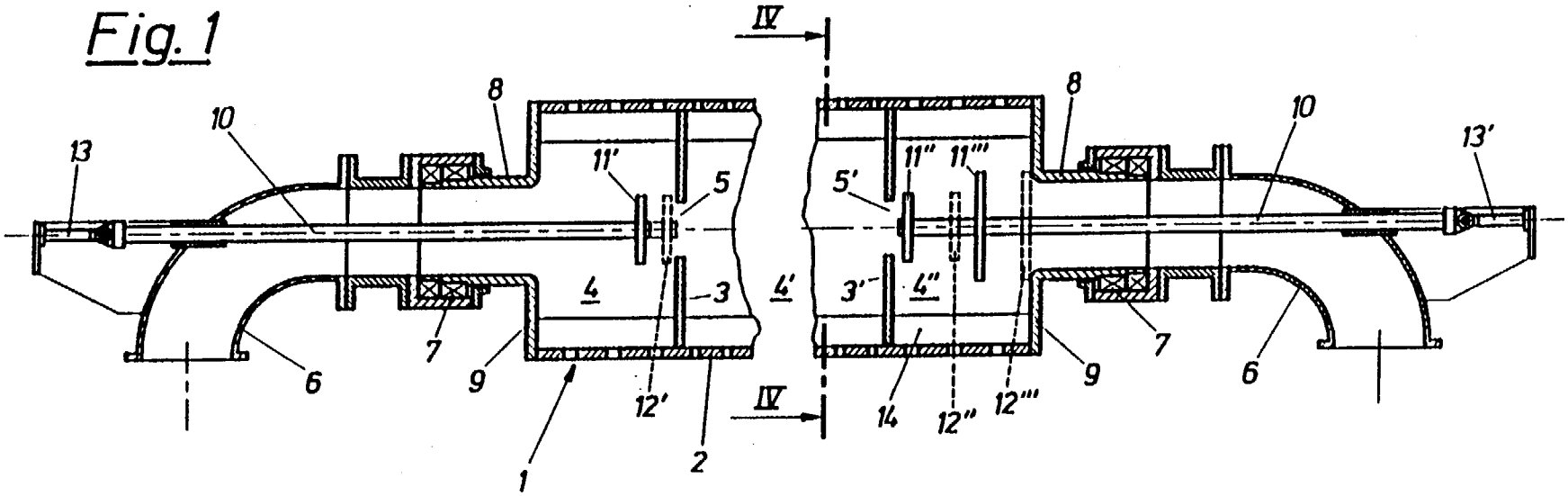
FIG. 1 shows a longitudinal axial section through a suction roll according to the invention, FIG. 2 a modification with two independently adjustable discs, FIG. 3 a detail of the perforated roll jacket in the region of a chamber dividing wall, FIG. 4 a section in the plane defined by the line IV—IV of FIG. 1, FIG. 5 a further modification according to the invention, FIG. 6 a section defined by the line VI—VI of FIG. 5, FIG. 7 modification of the suction roll according to the invention with a fixed suction space and FIG. 8 the pressure profile along the roll axis.

FIG. 1 shows a longitudinal section through a suction roll 1 according to the invention, with means for the intentional control of the vacuum profile along the roll axis. The suction roll 1 consists of a perforated roll jacket 2 and a means, such as for example the sheet metal structures 3,3', which are fixed to the roll jacket 2 and serve to divide the roll's inner space into several chambers 4,4',4''. The sheet metal structures or discs 3,3' have centrally located openings 5,5' through which air can be sucked out of chambers, such as 4', through the outer chambers, such as 4,4'' and then through the tubular ducts 6. The pumping out also takes place through the tube sections 8 which are rotatably mounted in bearings 7 and which are fixed to the covers 9 on the end faces, and thus to the roll jacket 2. A seal is present between the rotating tube sections 8 and the tubular ducts 6. Slide rods 10, on which one or more discs 11',11'',11''' are mounted, enter the suction roll 1 through the tube sections 8. These discs are able to close off the associated openings 5,5' and the opening of the tube section 8 into the side chamber 4'' respectively. For start-up operation the discs are brought into positions 12',12'' and 12''' so that a good or high vacuum may only be formed in chamber 4. No pumping out takes place in the other chambers 4',4''. During operation, the discs 11',11'' and 11''' are positioned using the cylinders 13 or 13', so as to produce a restricting effect in the openings 5,5' between the discs and the dividing sheets 3,3' which enables a desired vacuum profile along the axis of the suction roll 1 to be realised.

In-built fittings or baffles 14 for the reduction of possible rotational or vortex-like flow are shown on the inner surface of the roll jacket 2. The chamber 4 is on the so-called control side of the paper machine, that is the side which is accessible by the operators. It is from this side that a lead-in strip is initially fed through the paper machine, also during start-up operation. The chamber 4'' is on the so-called drive side of the machine, on which the entire drive machinery is placed and which, as a result, has poor access.

Figure 2:
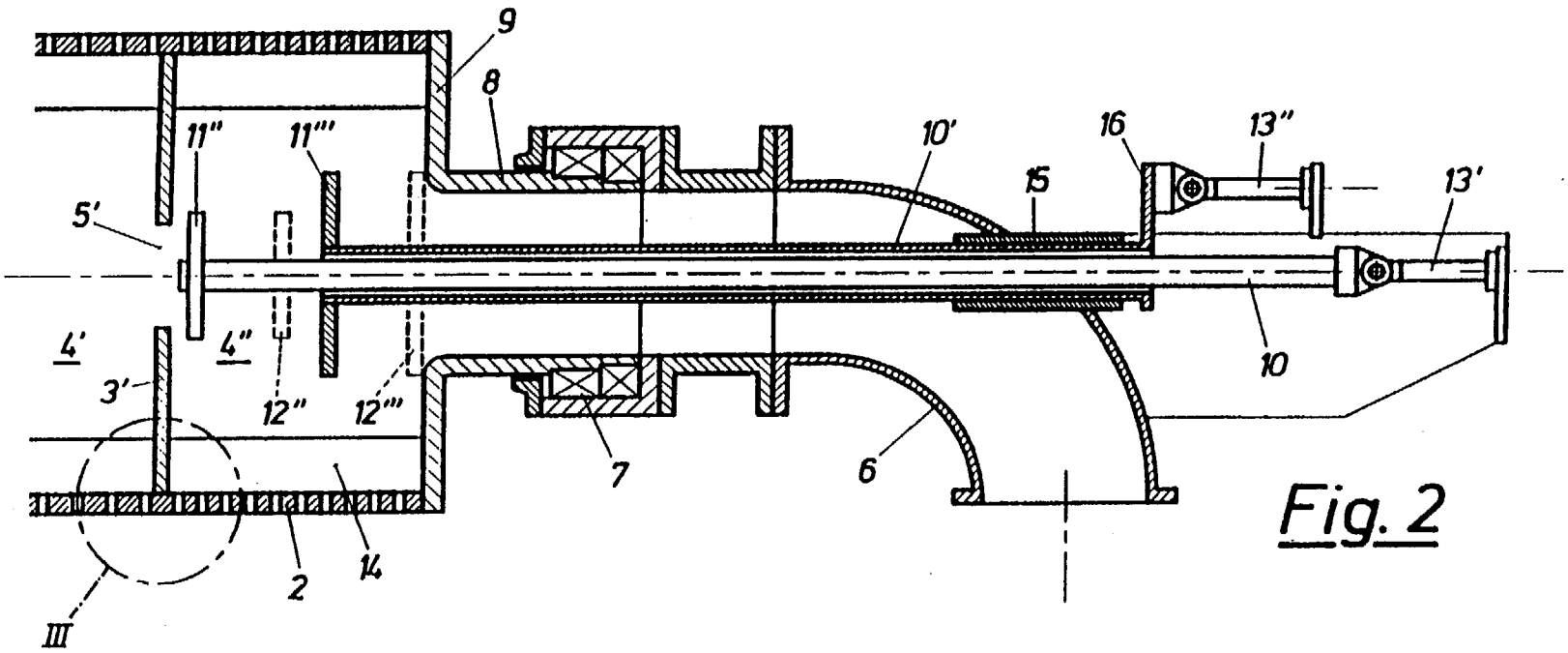

In FIG. 2 there is shown a further variant of the invention, in which a slide rod 10 with a disc 11'' is provided, which can be shifted by a pneumatic or hydraulic cylinder. The slide rod 10 runs in a tube 10', which can be displaced within a guide 15. A disc 11''' is mounted at one end of the tube and a cylinder 13'' which is used for the translation control is mounted at the other end of the tube, by means of a rigidly attached plate 16. The discs 11'' and 11''' can thereby be translated independently of each other enabling the vacuum levels in chambers 4' and 4'' to be adjusted independently not only with respect to each other but also with respect to the vacuum in chamber 4 or in any other chambers which may be present.

Figure 4:
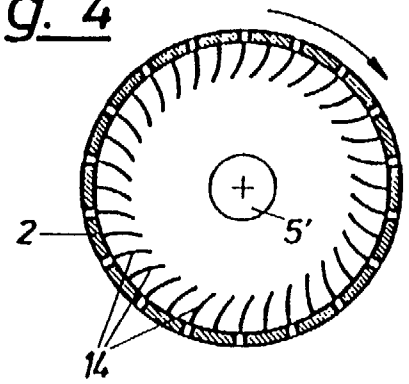
Figure 3:
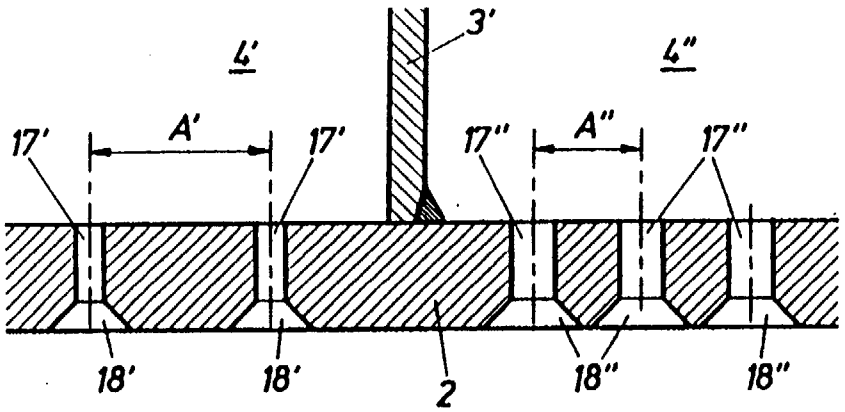

FIG. 3 shows a detail of the region III marked in FIG. 2, highlighting in particular the perforated roll jacket 2 and sheet metal disc 3' Bores 17' are located in the region of chamber 4. The bores 17' are countersunk 18' on the outer surface of the roll jacket 2, giving these regions a larger effective free surface than that which would be associated with the bores 17' alone. In the region of the chamber 4'', bores 17'' are provided which have a larger diameter than the bores 17'. Furthermore, the pitch A'' is smaller than the pitch A' in the region of the chamber 4'. Thereby, the free surface in the region of the chamber 4'' is significantly larger than that in the region of chamber 4' due to the above mentioned factors of the larger number of bores 17'' per unit surface area of the roll and their larger diameter. This free surface can be increased still further through the countersinking 18'' of the bores 17''. These countersinks 18' and 18'' respectively could basically also be formed as grooves extending around the roll periphery. As shown for instance in FIG. 4, fittings or baffles 14 in the form of vanes can be fixedly connected to the inner surface of the roll jacket 2, which serve to reduce or prevent rotational or vortex flow.

Figure 5:
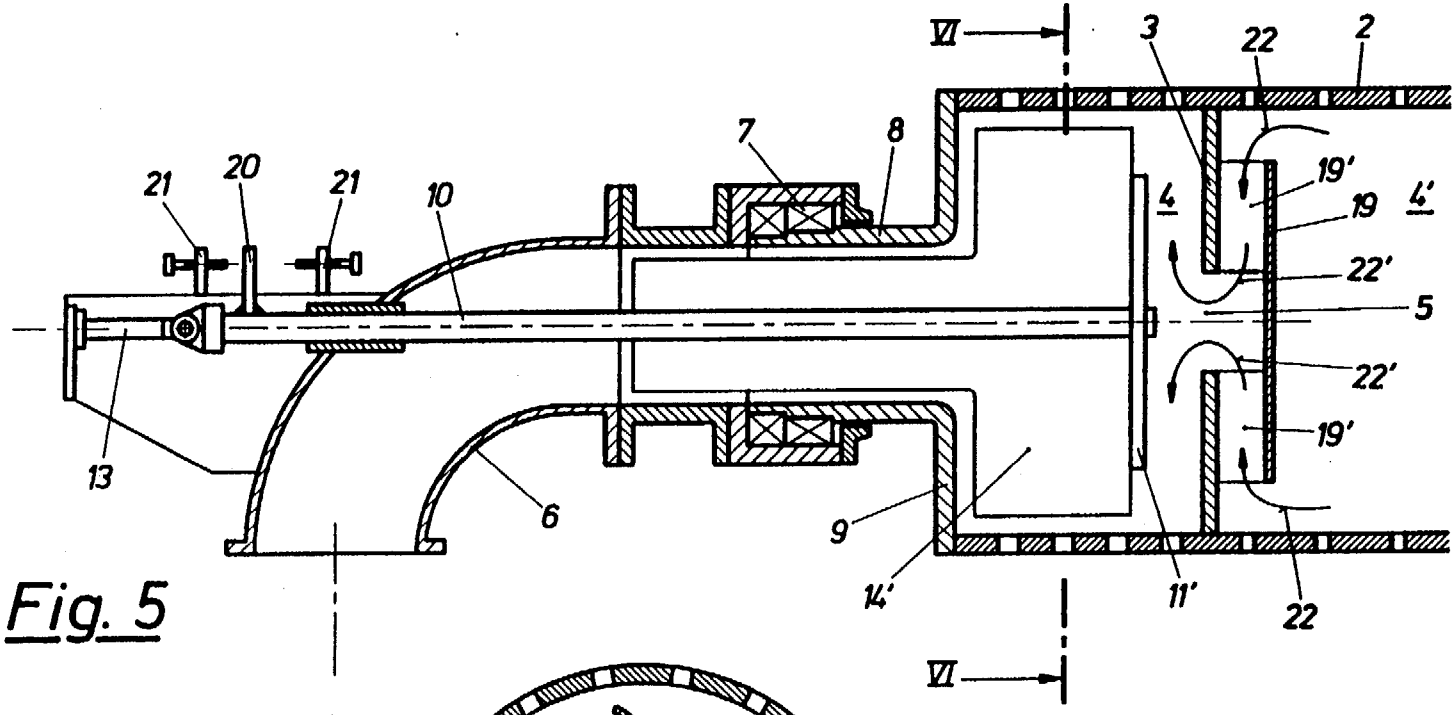
Figure 6:
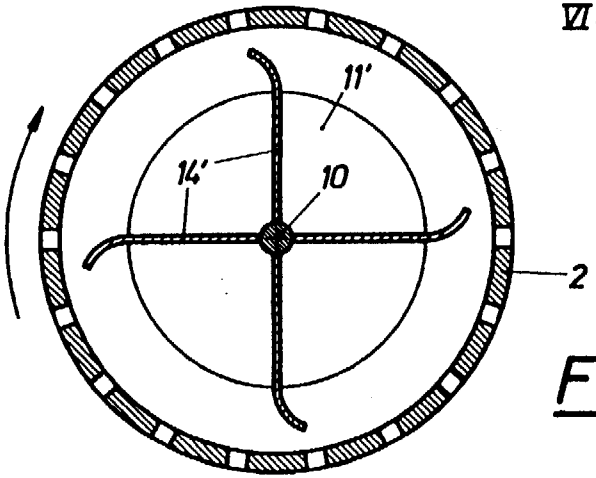

A further embodiment according to the invention for reducing undesired rotational or vortex flows, is shown in FIG. 5. In this case, reduction or prevention of vortices is achieved with vanes 14' mounted onto the slide rod, the vanes 14' extending towards and up to the disc 11'. The vanes 14' extend radially beyond the peripheral edge of the disc 11'. Limitation of the travel of the slide rod 10 is achieved by a plate 20 mounted on it and also by threaded adjustable travel stops 21,21' mounted on a fixed plate. In principal, these stops could also be mounted inside the adjusting cylinder 13. In order to calm the flow through the opening 5 from chamber 4' to chamber 4 during pumping, a plate 19 may be provided which is connected to the partition plate 3 by ribs 19'. In this case, air flows into the opening 5 in the direction of the arrow 22 through the channels formed by the plate 19, ribs 19' and partition plate 3'. The air is then deflected as shown by arrow 22', eventually flowing parallel to the face of the disc 11' in a radially outward direction with respect to the roll symmetry. The section along the line VI—VI is shown in FIG. 6.

Figure 7:
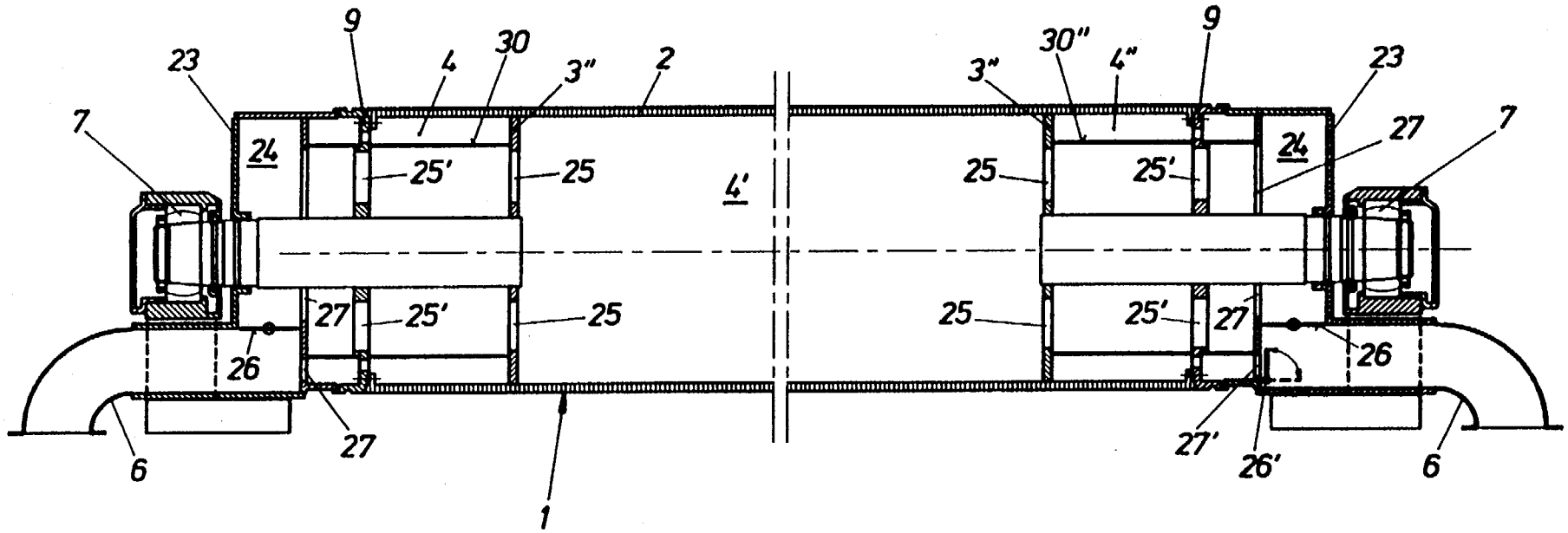

A further variant of the invention is shown in FIG. 7. Once more, the suction roll has a perforated roll jacket 2 divided into several chambers 4,4',4''. Here, pumping out takes place via the ducts 6 and a fixed suction space or pumping out volume 24 located in the end face regions. The volumes 4 and 4'' are bounded by cylinder walls 30 and 30'' which are fixed to the suction roll and hence rotate with it. The air is sucked out of the chamber 4' into the volume 24 through apertures 25 in the partition walls 3'', through openings 25' in the end walls 9 and through openings 27 in the walls of the fixed suction space 24. The adjustment of the vacuum in the chamber 4'' takes place by means of a flap 26' through an opening 27'. The pumping out of chamber 4 in FIG. 7 is achieved similarly via an opening 27', and in this case the full effect of the suction pressure comes into action. A flap for vacuum adjustment may equally well be provided here also. During start-up operation, the flaps 26,26' of FIG. 7 are closed so that only the chamber 4 on the control side is held under vacuum, this is however sufficient to provide for a good location of the lead-in strip at the edge or marginal region of the roll.

Figure 8:
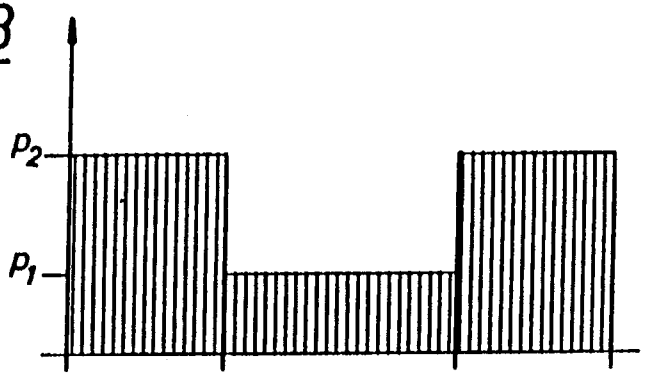

FIG. 8 shows a typical vacuum profile along the roll axis, i.e. in the longitudinal direction of the roll. A higher vacuum is maintained at the edges or in the marginal edge regions than in the central region in order to effect good location and shrinkage prevention of the paper web. In start-up operation, the highest vacuum is maintained at the control side end, that is the left hand side of FIG. 8, while in the other regions practically no vacuum exists. The levels of the vacuum over the width of the web, i.e. along the longitudinal axis of the suction roll, can now also be adjusted independently of one another in operation, in accordance with the compartmentalised design, and in accordance with the quality requirements of the various paper types. With corresponding differing states of adjustment of the various suction rolls over which the paper web is fed one after the other, and bearing in mind that the web may also pass over additional intermediate rolls, such as for instance drying cylinders, it is possible to achieve a time dependent variation of the vacuum loading of the paper web during production.

The illustrated embodiments are purely enumerated by way of example and can be appropriately supplemented or modified by a person skilled in the art within the framework of the claims.

We claim:

1. A method for guiding a fibrous web over an elongated, tubular suction roll during a start-up period and a subsequent operating period, the roll having a tubular wall defining an exterior roll surface, a central region, an end region on each side of the central region, and an interior space, the method comprising the steps of rotating the roll about its longitudinal axis; during the start-up period contacting a lead-in strip of the web with a portion of the exterior surface overlying at least one of the end regions of the roll; forming a vacuum in at least a portion of the interior space of the roll; communicating the vacuum in the interior space through the wall to the portion of the exterior roll surface only to thereby attach the lead-in strip to the portion of the exterior surface; continuing the step of rotating the roll and placing the fibrous web against another portion of the exterior roll surface during the operating period so that the web overlies the center region of the roll; and communicating the vacuum in the interior space of the roll through the wall to the another portion of the exterior roll surface to thereby draw the web overlying the central region against the exterior roll surface.

2. A method according to claim 1 wherein the step of communicating comprises the step of forming a multiplicity of apertures extending through the wall and in fluid communication with the interior space of the roll and the exterior surface thereof.

3. A method according to claim 1 wherein the step of communicating the vacuum to the another portion of the exterior roll surface comprises the step of subjecting a further portion of the interior space extending over substantially the full length of the central region to the vacuum.

4. A method according to claim 3 including the step of varying a magnitude of the vacuum between at least one end region and the central region of the roll.

5. A method according to claim 1 including the step of steplessly varying the vacuum formed in the interior space of the roll.

6. A method according to claim 1 wherein the step of forming a vacuum comprises the step of generating a vacuum with a power driven vacuum pump, and including the step of controlling the operation of the power driven vacuum pump with a computer to thereby regulate the magnitude of the vacuum in the interior space of the roll.

7. A method according to claim 6 including the step of presetting desired values for the magnitude of the vacuum for the start-up period and the operating period in the computer and, with the preset values, controlling the power driven vacuum pump.

8. Apparatus for guiding a moving, fibrous web comprising: a hollow suction roll having a cylindrical tubular wall including perforations fluidly communicating an interior space of the roll with an exterior surface of the roll defined by the wall; means located in the interior space dividing the space into a central region and first and second end compartments located at end regions of the roll; vacuum means for generating a vacuum; conduit means separately fluidly connecting the vacuum means with the end compartments; means for fluidly coupling the central region with the vacuum means; regulating means operable from an exterior of the roll for regulating fluid flow between the central region and the end compartments to thereby permit a control of a magnitude of the vacuum therein; and means associated with the regulating means for completely fluidly separating at least one end compartment from a remainder of the interior space of the suction roll; whereby the application of any vacuum to the at least one end compartment can be prevented and the magnitude of the vacuum in the end compartments and the central region can be regulated from the exterior of the roll while the apparatus is in operation.

9. Apparatus according to claim 8 wherein the regulating means comprise first and second regulating devices located proximate the first and second end compartments, respectively.

10. Apparatus according to claim 8 wherein the regulating means comprise devices located in the interior space of the roll and movable along an axis of the roll for regulating the magnitude of the vacuum in the interior space of the roll.

11. Apparatus according to claim 8 wherein the perforations in the wall comprise openings, and wherein the number of openings per unit length of the wall varies over an axial length of the roll.

12. Apparatus according to claim 10 wherein the devices comprise a plurality of disks, and including an axially movable slide rod operatively connected with the roll and holding the disks.

13. Apparatus according to claim 12 wherein the disks and the slide rod form a unit, and including means rotatably mounting the rod relative to the roll so that the unit remains stationary while the roll rotates relative to the unit during operation of the apparatus.

14. Apparatus according to claim 13 wherein the unit and the roll are configured to form a gap between the disks and cooperating parts attached to and rotating with the roll.

15. Apparatus according to claim 14 including means for adjusting the size of the gap.

16. Apparatus according to claim 15 including at least two disks mounted on one slide rod.

17. Apparatus according to claim 12 including a tubular sleeve coaxially disposed about the slide rod, and wherein a disk is attached to the slide rod and another disk is attached to the tubular sleeve.

18. Apparatus according to claim 8 including a baffle defined by a vane disposed in the interior space of the roll for inhibiting rotational fluid flow in the interior space.

19. Apparatus according to claim 18 wherein the vane is fixedly attached to an interior surface of the wall and extends from the interior surface towards the axis of the roll.

20. Apparatus according to claim 18 wherein the vane is mounted to at least one disk.

21. Apparatus according to claim 8 including at least one flow directing member positioned in the interior space of the roll and between regions of the interior space where different pressures prevail for inhibiting turbulent fluid flows.

22. Apparatus for guiding a moving, fibrous web comprising: a hollow suction roll having a cylindrical tubular wall including perforations fluidly communicating an interior space of the roll with an exterior surface of the roll defined by the wall; means located in the interior space dividing the space into a central regions and first and second end compartments located at end regions of the roll; vacuum means for generating a vacuum; a stationary suction space disposed exteriorly of the roll and connected to the vacuum means; means fluidly communicating the stationary Suction space with at least one of the end compartments; and means for regulating the fluid flow between the vacuum means and the interior space.

23. Apparatus according to claim 22 including an impervious, tubular member concentrically and fixedly mounted to the roll and extending axially over the length of at least one of the end compartments, the member being disposed radially inward of the tubular wall to define an annular end space between the tubular wall and the tubular member, and wherein the suction space is in fluid communication with the end space of the at least one end compartment.

24. Apparatus according to claim 23 wherein both end compartments of the roll include said tubular member to form an annular end space at each end chamber, and including a separate stationary suction space in fluid communication with each end space, and wherein the regulating means includes means in fluid communication with at least one end compartment for influencing a magnitude of the vacuum applied to the central region.

25. Apparatus according to claim 23 wherein the stationary suction space is in direct fluid communication with only one of the end compartments, and wherein the regulating means includes flow control means in fluid communication with the stationary suction space for regulating the vacuum applied to the other one of the end compartments and the central region.

26. Apparatus according to claim 24 wherein the means for influencing comprises a flap.

27. Apparatus according to claim 24 wherein the means for influencing includes means for completely preventing fluid communication between the vacuum means and one of the end compartments and the central region.

28. Apparatus according to claim 24 wherein the means for influencing includes a flap for blocking fluid communication between one of the end compartments and the vacuum means during a start-up period of the apparatus.

29. Apparatus according to claim 8 including first and second suction rolls serially arranged in the direction of web movement, and wherein the regulating means operable from the exterior of the roll independently control and regulate the presence of, and if present the magnitude of, the vacuum in the compartments and the central region of each suction roll.

* * * * *